United States Patent [19]

Demirjian

[11] 4,444,228

[45] Apr. 24, 1984

[54] WIRE UNWRAPPING TOOL

[76] Inventor: John Demirjian, 69 Harlow St., Arlington, Mass. 02174

[21] Appl. No.: 398,973

[22] Filed: Jul. 16, 1982

[51] Int. Cl.[3] ..... B21F 1/02

[52] U.S. Cl. ..... 140/123; 29/764

[58] Field of Search ..... 140/123, 124; 29/426.1, 29/426.4, 426.5, 764

[56] References Cited

U.S. PATENT DOCUMENTS

| | | | |
|---|---|---|---|
| 3,521,678 | 7/1970 | Petree | 140/123 |
| 4,064,581 | 12/1977 | Kober | 29/764 |
| 4,195,401 | 4/1980 | Galloup | 29/764 |
| 4,236,303 | 12/1980 | Sprenkle | 140/123 |

*Primary Examiner*—Francis S. Husar
*Assistant Examiner*—Linda McLaughlin
*Attorney, Agent, or Firm*—Wolf, Greenfield & Sacks

[57] ABSTRACT

A wire unwrapping tool comprising a cylindrical shaft having an outer axial bore at one end, and an inner bore further within said shaft, concentric with and opening to said outer bore. A third bore is located through a diameter of the tubular shaft in such a position as to define sharp gripping edges at the inner face of said outer bore, for grasping the conductor wire to be unwrapped when the shaft is placed over the wrapped terminal. In a further embodiment, the shaft includes axial gripping edges extending from the end of the shaft to the diametrical bore.

7 Claims, 13 Drawing Figures

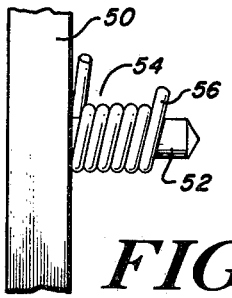
FIG. 1
FIG. 2A
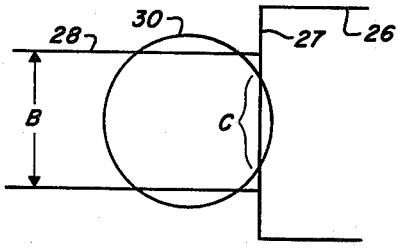
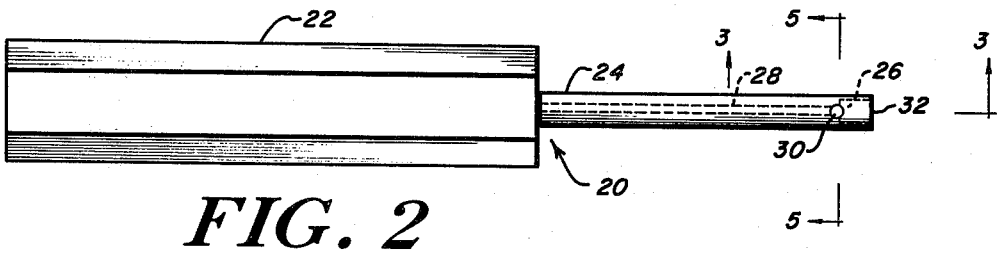
FIG. 2
FIG. 4
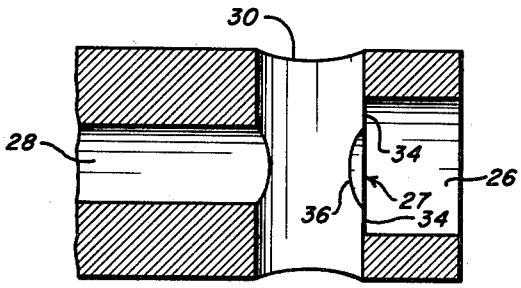
FIG. 3
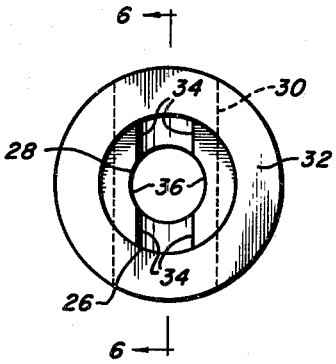
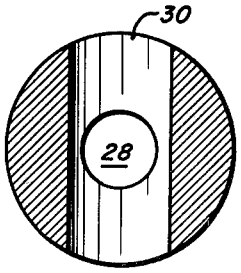
FIG. 5
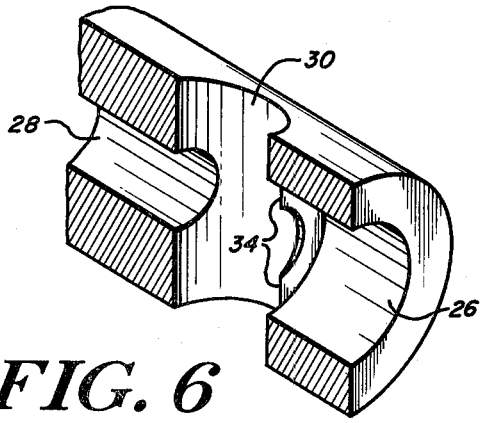
FIG. 6

WIRE UNWRAPPING TOOL

FIELD OF THE INVENTION

This invention relates to a wire unwrapping tool, and particularly to an improved wire unwrapping tool easily manipulated by hand and capable of unwrapping and removing a wire wrapped in either a clockwise or counter-clockwise direction.

BACKGROUND OF THE INVENTION

Various tools, both manual and automatic, have been developed for unwrapping and removing solderless wrapped connections. Such a connection comprises a flexible conductor wire tightly coiled or wrapped around a terminal pin in a series of helical convolutions.

Previously known unwrapping tools often employ complicated structures to achieve the goal of removing a wrapped wire from a terminal. For example, Shepard U.S. Pat. No. 3,095,913 discloses a manual unwrapping device that fits over the wrapped terminal, and has a projection and a groove at its end for catching the end of the wire forming the wrapped connection. Kober U.S. Pat. No. 4,064,581 is directed to a wire strip, wrap, and unwrap tool that includes an unwrapping bit having a knife edge at its end, angled so as to facilitate insertion of the knife edge under the end of the wrapped coil. The devices disclosed in the Shepard and Kober patents are useful for unwrapping wire that has been wrapped in one particular direction—either clockwise or counter-clockwise. Galloup U.S. Pat. No. 4,195,401 discloses a device that may be used to unwrap wire that has been wrapped in either direction. The Galloup device comprises an unwrapping bit having a conical recess at its end, as well as longitudinal slots opening to the end face and the conical recess.

It is an object of the present invention to provide a new and improved wire unwrapping tool that is relatively uncomplicated and inexpensive in construction.

It is another object of this invention to provide such a tool that permits rapid removal of a conductor wire that has been wrapped in either direction.

It is still another object of this invention to provide such a tool that is simple and reliable in use, and that can be readily cleaned as appropriate.

These and other objects of the invention ae achieved by means of a hand tool comprising a cylindrical shaft having an outer axial bore in one end, and an inner bore further within said shaft, concentric with and opening to said outer bore. A third bore is located through a diameter of the tubular shaft in such a position as to define sharp gripping edges at the inner face of said outer bore, for grasping the conductor wire to be unwrapped when the shaft is placed over the wrapped terminal. In a further embodiment, said shaft includes axial gripping edges extending from said end to said diametrical bore.

These and other features and advantages of the subject invention will be understood from the following detailed description of the preferred embodiments of the invention, taken in conjunction with the accompanying drawings.

BRIEF DESCRIPTION OF THE DRAWINGS

FIG. 1 is an enlarged view of a typical solderless wrapped wire connection;

FIG. 2 is an enlarged longitudinal side elevation of an unwrapping tool in accordance with the present invention;

FIG. 2A is an enlarged illustration of the intersection of the diametrical bore with the inner and outer bores as seen in FIG. 2;

FIG. 3 is a cross-sectional view of the end portion of the tool of FIG. 2, taken along the line 3—3 of FIG. 2;

FIG. 4 is an enlarged end view of the shaft of the tool of FIG. 2;

FIG. 5 is an enlarged cross-sectional view of the shaft of FIG. 2, taken along the line 5—5 of FIG. 2;

FIG. 6 is a perspective view of the cross-section of the end portion of the shaft of FIG. 2 as seen in FIG. 3.

DESCRIPTION OF THE PREFERRED EMBODIMENTS

Figure 7:
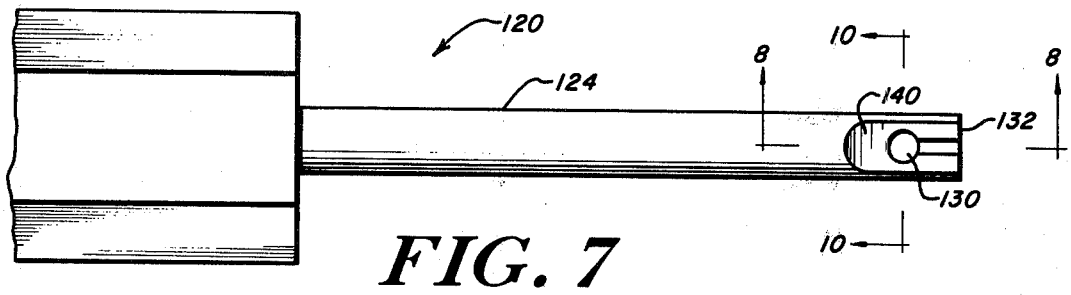
FIG. 7 is an enlarged longitudinal side elevation of another embodiment of an unwrapping tool in accordance with the present invention.

Referring to FIG. 1, there is depicted a typical solderless wrapped wire connection. Terminal pin 52 projects from circuit board 50. Conductor wire 54 is wrapped tightly around terminal pin 52 in a series of helical convolutions. A typical circuit board is likely to contain hundreds of terminal pins such as pin 52, wrapped with conductor wires in a manner depicted in FIG. 1. Terminal pins are often square in cross-section, though terminal pin 52 is depicted as circular in cross-section. The conductor wire 54 of FIG. 1 is wrapped in a clockwise direction as seen by an observer looking toward the projecting terminal pin 52 (i.e., from the right in FIG. 1). However, the instant invention is equally useful in the unwrapping and removal of wire wrapped in a counter-clockwise direction.

FIG. 2 depicts an unwrapping tool 20 according to the instant invention, comprising handle 22 integrally attached to cylindrical shaft 24. Handle 22 may be made of plastic material, with shaft 24 attached thereto by any conventional means, such as press-fitting. Shaft 24 is comprised of a hardenable steel material, preferably heat-treated carbon tooled steel, and includes at its end 32 away from said handle, an axial outer bore 26 extending into shaft 24 to a substantially planar inner face 27. Axial inner bore 28 is concentric with outer bore 26, and opens to inner face 27 of outer bore 26. [See FIG. 2A]. Diametrical bore 30 is preferably slightly larger in diameter than inner bore 28 but smaller in diameter than outer bore 26. The axis of diametrical bore 30 intersects and is perpendicular to the axis of shaft 24. Diametrical bore 30 is preferably located at a position from the end 32 of shaft 24 such that the intersection of a circular section of diametrical bore 30 with the plane of inner face 27 of outer bore 26 comprises a chord of length less than that of the diameter of inner bore 28. Thus, as illustrated in FIG. 2A, distance C is of less length than diameter B.

At the intersection of diametrical bore 30 with the inner face 27 of outer bore 26 there are formed four sharp gripping edges 34, best seen in FIGS. 4 and 6. Inner bore 28 can be seen in FIG. 3 to extend a short distance from the inner face 27 of outer bore 26 toward diametrical bore 30, forming curved guide areas 36. These curved guide areas 36 serve to guide the terminal pin into the tool for proper placement of the tool, as explained further below.

To unwrap a wrapped wire connection such as that of FIG. 1 by means of tool 20, shaft 24 is placed over terminal pin 52 (FIG. 1) such that pin 52 enters through outer bore 26, and is guided further into the tool by curved guide areas 36 of inner bore 28 until such point as gripping edges 34 contact the outer convolution 56 of wrapped wire 54. By then turning tool 20 in a direction opposite to the direction in which the wire is wrapped (i.e., by turning the tool in a counter-clockwise direction to remove the wrapped wire of FIG. 1) to loosen the wrapped wire from the terminal, and by pulling the tool away from circuit board 50, one may simultaneously unwind the wire and remove it from terminal pin 52. It is readily apparent that tool 20 may also be utilized in a clock-wise direction to remove a wire wrapped in a counter-clockwise direction, curved guide areas 36 and gripping edges 34 acting respectively to guide the terminal pin and to grip the wrapped wire.

Figure 8:
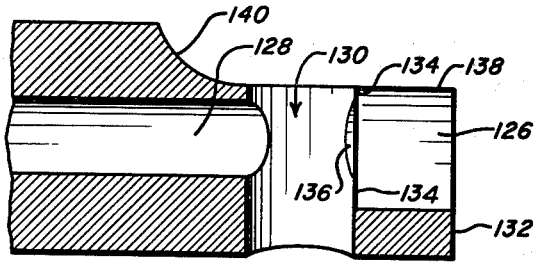
FIG. 8 is an enlarged cross-sectional view of the end portion of the tool of FIG. 7, taken along the line 8—8 of FIG. 7.
Figure 9:
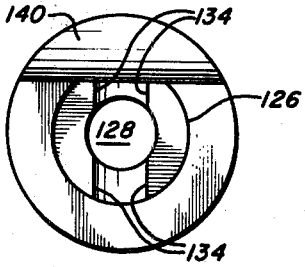
FIG. 9 is an enlarged end view of the shaft of the tool of FIG. 7.
Figure 10:
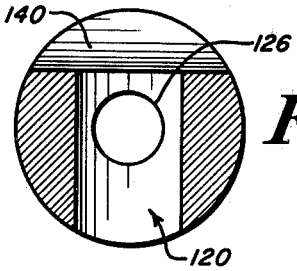
FIG. 10 is an enlarged cross-sectional view of the shaft of FIG. 7, taken along the line 10—10 of FIG. 7.
Figure 12:
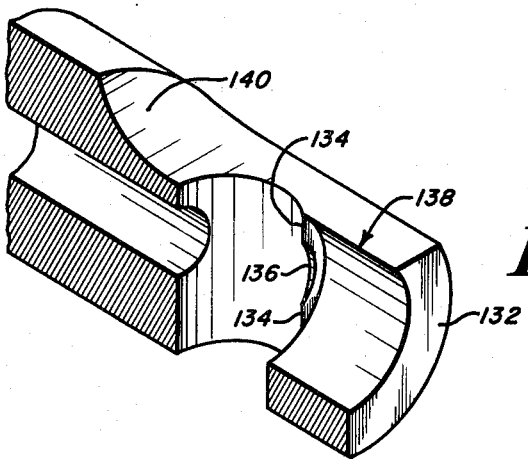
FIG. 12 is a perspective view of the cross-section of the end portion of the shaft of FIG. 7 as seen in FIG. 8.

FIG. 7 illustrates an unwrapping tool 120 according to a further embodiment of the present invention, wherein cylindrical shaft 124 is similar to shaft 24 of FIG. 2, except that a portion of shaft 124 has been removed to form a surface 140 that extends parallel to the axis of shaft 124 for a distance from end face 132 to a point slightly past diametrical bore 130, at which point said surface 140 curves away from said axis. (See FIGS. 8 and 12). The plane of surface 140 preferably intersects a circular section of outer bore 126 along a chord of said circular section of length greater than the diameter of inner bore 128, but less than that of outer bore 126. (See FIG. 9).

Tool 120 includes gripping edges 134 and curved guide areas 136 formed by the intersection of diametrical bore 130 with axial outer bore 126 and axial inner bore 128. Tool 120 also includes two axial gripping edges 138 formed by the removal of material from shaft 124 in forming surface 140. Axial gripping edges 138 extend substantially parallel to the axis of shaft 124 along the entire depth of outer bore 126, i.e., from end face 132 to diametrical bore 130.

Tool 120 is employed in a manner similar to that of tool 20—i.e., by placing shaft 124 over a terminal pin such that the pin enters through outer shaft 126 into inner bore 128, being guided by curved guide areas 136. Axial gripping edges 138 and/or gripping edges 134 contact and grip the wrapped wire, so that by appropriately turning tool 120 and pulling the tool away from the terminal pin, one may unwrap and remove the wire from the pin.

Figure 11:
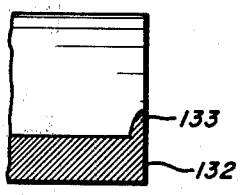
FIG. 11 depicts a modification of the end portion of the tool of FIG. 8.

Tool 120 (and tool 20 of FIGS. 1–6 as well) may further include an inwardly projecting rim 133 at end face 132 (FIG. 11) for better alignment and gripping of the wire to be removed. Rim 133 may be formed by striking end face 132 with a blunt instrument.

It may be seen from the foregoing, that the embodiments described herein are by way of illustration and not of limitation, and that various changes in and other modifications to the construction, composition, and arrangement of parts are possible in light of the above teachings. Accordingly, it is to be understood that other embodiments of this invention could be utilized without departing from the spirit and scope of the present invention, as set forth in the appended claims.

I claim:

1. An unwrapping tool for unwrapping and removing a wire from a terminal pin upon which it is wrapped, comprising:

a cylindrical shaft;

said shaft having an axial outer bore extending from a first end of said shaft to a substantially planar inner face of said outer bore, for receipt of the wrapped wire when the shaft is placed over the terminal pin;

said shaft having an axial inner bore concentric with said axial outer bore and extending axially inward from said inner face of said axial outer bore, for receipt of said terminal pin when the shaft is placed over the terminal pin;

said shaft having a diametrical bore whose axis is perpendicular to and intersects the axis of said inner bore, said diametrical bore being located at a longitudinal axial position along such shaft such that a portion of said diametrical bore intersects said inner face of said axial outer bore in such a way as to form gripping means for gripping the wrapped wire when the tool is placed over the terminal pin.

2. The tool of claim 1 wherein said portion of said diametrical bore intersects said axial inner bore and said inner face in such a way as to form guide means adjacent to said gripping means for guiding said terminal pin into said axial inner bore.

3. The tool of claim 2 wherein the intersection of a circular section of said diametrical bore with the plane of said inner face of said outer bore comprises a chord of said circular section, said chord being of a length less than the diameter of said inner bore.

4. The tool of claim 1, further comprising axial gripping means located on the circumference of said axial outer bore and extending parallel to the axis of said shaft from said first end of said shaft to said diametrical bore, for gripping the wrapped wire when the tool is placed over the terminal pin.

5. The tool of claim 2, further comprising axial gripping means located on the circumference of said axial outer bore and extending parallel to the axis of said shaft from said first end of said shaft to said diametrical bore, for gripping the wrapped wire when the tool is placed over the terminal pin.

6. The tool of claim 3, further comprising axial gripping means located on the circumference of said axial outer bore and extending parallel to the axis of said shaft from said first end of said shaft to said diametrical bore, for gripping the wrapped wire when the tool is placed over the terminal pin.

7. The tool of claim 4, wherein the distance between said axial gripping edges is greater than the diameter of said axial inner bore.

* * * * *